United States Patent [19]

Jamzadeh et al.

[11] Patent Number: 5,040,026

[45] Date of Patent: Aug. 13, 1991

[54] METHOD AND APPARATUS FOR TRANSFERRING COLOR TONER IMAGES IN REGISTRATION

[75] Inventors: Fereidoon S. Jamzadeh, Fairport; Timothy J. Young, Williamson, both of N.Y.

[73] Assignee: Eastman Kodak Company, Rochester, N.Y.

[21] Appl. No.: 488,546

[22] Filed: Mar. 5, 1990

[51] Int. Cl.[5] ..... G03G 15/14

[52] U.S. Cl. ..... 355/271; 355/317; 355/326

[58] Field of Search ..... 355/271, 274, 272, 277, 355/279, 326, 327; 118/317, 645; 346/157; 430/126, 42, 357

[56] References Cited

U.S. PATENT DOCUMENTS

| | | | |
|---|---|---|---|
| 4,515,460 | 5/1985 | Knechtel | 355/274 X |
| 4,519,700 | 5/1985 | Barker et al. | 355/317 X |
| 4,605,298 | 8/1986 | Russel et al. | 355/271 |
| 4,733,269 | 3/1988 | Kasahara et al. | 118/645 X |
| 4,796,054 | 1/1989 | Maeno et al. | 355/243 |
| 4,872,037 | 10/1989 | Kasahara et al. | 355/271 |
| 4,884,105 | 11/1989 | Joseph et al. | 355/271 X |
| 4,914,477 | 4/1990 | Young et al. | 355/317 X |

FOREIGN PATENT DOCUMENTS

| | | | |
|---|---|---|---|
| 0011975 | 1/1983 | Japan | 355/277 |
| 0138265 | 6/1986 | Japan | 355/317 |
| 0226767 | 10/1986 | Japan | 355/271 |
| 0247378 | 10/1987 | Japan | 355/274 |
| 0166070 | 6/1989 | Japan | 355/271 |

*Primary Examiner*—A. T. Grimley
*Assistant Examiner*—William J. Royer
*Attorney, Agent, or Firm*—Leonard W. Treash, Jr.

[57] ABSTRACT

Multicolor toner images are formed on a receiving surface by superimposing single color toner images formed electrostatically on an image member, in registration on a receiving surface. The receiving surface is rotated by a transfer member, for example, a transfer drum, repeatedly through transfer relation with the image member. To improve transfer and avoid wear of the image member, the transfer member is driven by the image member during transfer. To improve registration the transfer member is separated from the image member between transfers and reindexed. A stepper motor is used for such reindexing. The invention is particularly usable in transfers using heat, especially to a heat softenable outer surface of a receiving sheet.

28 Claims, 3 Drawing Sheets

METHOD AND APPARATUS FOR TRANSFERRING COLOR TONER IMAGES IN REGISTRATION

FIELD OF THE INVENTION

This invention relates to formation of a multicolor toner image, and more specifically to an apparatus for precisely transferring a series of different color toner images in registration to a receiving surface.

BACKGROUND ART

In conventional color electrophotogrphy a series of electrostatic images are created on an image member. They are toned with different colored toners and then transferred in registration to a receiving surface to create a multicolor toner image. Typically, the receiving surface is a receiving sheet of paper or similar material which has been secured around the periphery of a transfer drum. The transfer drum is rotated in contact or near contact with the image member to repeatedly bring the receiving sheet into transfer relation with the consecutive images to overlay them in registration.

It is also known to transfer a series of color toner images in registration directly to the periphery of the transfer drum to create the multicolor image on that surface from which it is transferred in a single step to a receiving sheet.

As color toners get finer, for example, less than 10 microns, especially less than 3.5 microns, higher resolutions become possible, even approaching that of conventional silver halide photography. A limiting aspect of the process is the image-to-image registration provided by the transfer process.

Some transfer processes bring the receiving surface into light contact or just out of contact with the image member and transfer is accomplished by an electrostatic field. Using encoders and separate motors on both the image member and the transfer drum, accurate registration from image-to-image is possible with such systems. See, for example, U.S. Pat. Nos. 4,796,054 and 4,872,037.

However, fine toners do not generally transfer well electrostatically. Transfer systems using substantial amounts of pressure, sometimes in the presence of sufficient heat to soften or sinter the toner have been more successful in transferring fine toners. Further, for highest quality work, a receiving sheet with a heat softenable thermoplastic outer layer can be used to receive the toner in the presence of sufficient heat to soften the outer layer and soften or sinter the toner.

These transfer processes require more pressure than is common with ordinary electrostatic transfer. Unfortunately, if both the transfer drum and the image member are independently driven at more than light pressures, excessive wear will destroy a normal image member, for example, a photoconductive member, quite rapidly.

If the transfer drum is driven by the image member, such wear does not occur but registration is difficult to maintain. Even with precisely machined devices there is drift from image-to-image and also over time. Of most significance are slight misregistrations which would not be objectionable in an ordinary color copier, but would be objectionable in a quality photographic print. Also of significance, as the registration drifts, the image may be transferred out of registration with the means for holding the receiving sheet to the periphery of the transfer drum, for example, vacuum holes or gripping fingers.

DISCLOSURE OF THE INVENTION

It is an object of the invention to provide an apparatus for forming multicolor images in which a series of electrostatic images is formed on an image member, different colored toners are applied to the electrostatic images to form a series of different colored toner images and the toner images are transferred in registration to a receiving surface to form the multicolor image, in which the transfer surface is driven by the image member during transfer but in which the misregistration problems mentioned above are reduced or eliminated.

This and other objects are accomplished by an apparatus in which the surface that receives the transfer of the toner images is supported by a transfer member, for example, a drum. The apparatus has means for moving the transfer member through a path which includes a portion in which the transfer drum is driven by the image member, a portion in which the drum is moved out of engagement with the image member and a portion in which the drum is moved back into driven engagement with the image member. The apparatus includes means for rotating the transfer member at least a portion of the time it is out of such driven engagement and for timing said rotation with the movement of said image member to register the toner images on the receiving surface.

According to a preferred embodiment, the transfer member is a drum and the drum includes timing indicia. The apparatus includes means for sensing the presence or absence of the timing indicia at a predetermined location. The image member also includes image location indicia and the apparatus includes means for sensing the image location indicia. The means for rotating the drum when the drum is not engaging the image member rotates the drum until the timing indicia is located at the predetermined location. It then rotates the drum from said predetermined location in timed relation to the sensing of the image location indicia. Thus, for every revolution of the drum and every image that is transferred, the drum is separately reindexed according to the location of the image on the image member.

According to a further preferred embodiment the means for rotating the drum when it is out of engagement with the image member is a stepper motor. With presently available equipment we have found that the drum can be positioned at a stopping point within 0.00025 inches and similar accuracy is obtainable in engaging the transfer member and the image member upon sensing the image location indicia on the image member. This provides quality registration usable for multicolor image reproduction in both the regular photographic and graphic arts industries.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

In conventional color electrophotography and other similar processes a series of electrostatic images are created on an image member. For example, a photoconductive image member can be uniformly charged, imagewise exposed to a series of images to create a series of electrostatic images. This series of electrostatic images are then toned with different colored toners to create a series of different color toner images. These images are generally then transferred in registration to a receiving surface which can be the periphery of an intermediate transfer member or a receiving sheet carried by a transfer member.

Figure 3:
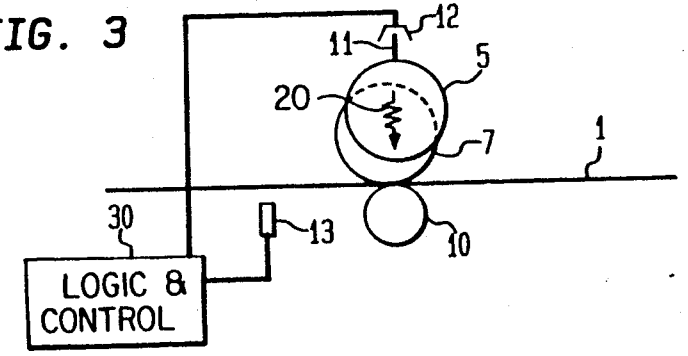
Figure 4:
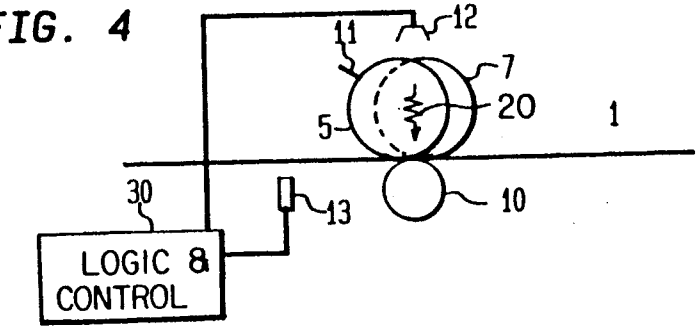
Figure 5:
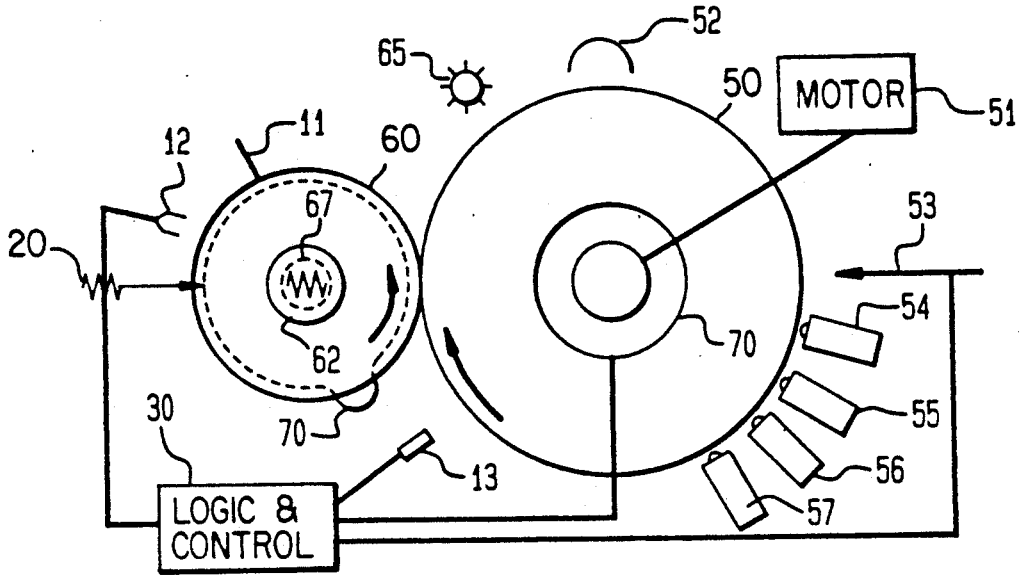
FIG. 5 is a side schematic view of a different embodiment of the invention.
Figure 6:
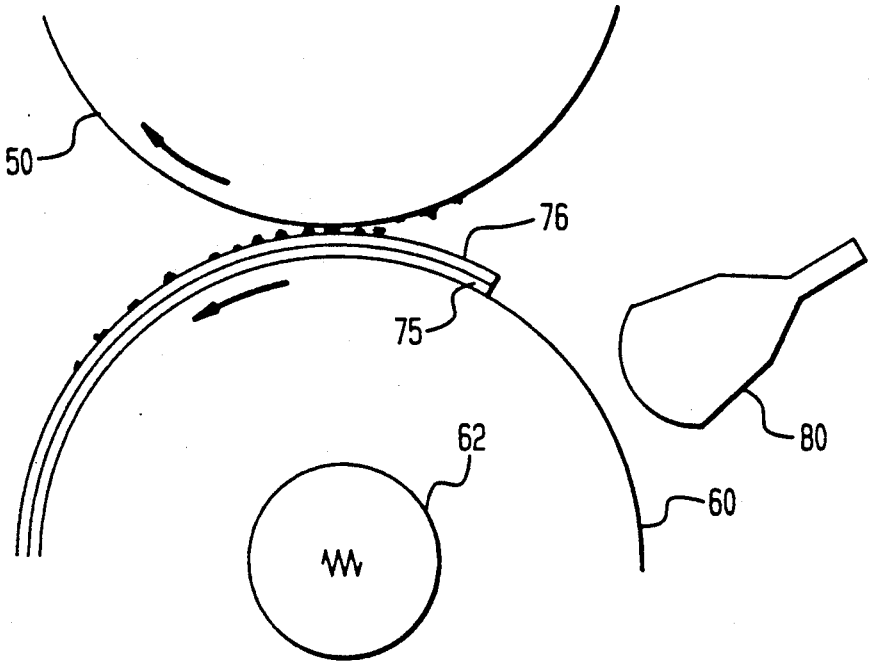
FIG. 6 is a partial cross-section of the apparatus shown in FIG. 5 illustrating a particular application for the invention with certain sizes exaggerated for clarity of illustration.

The surface of the image member carrying the toner images is driven through an endless path, generally at a constant rate of speed. The image member can be a drum or an endless belt. FIGS. 1–4 illustrate the invention with an image member that is an endless belt while FIGS. 5 and 6 illustrate the invention with a drum-shaped image member.

Figure 1:
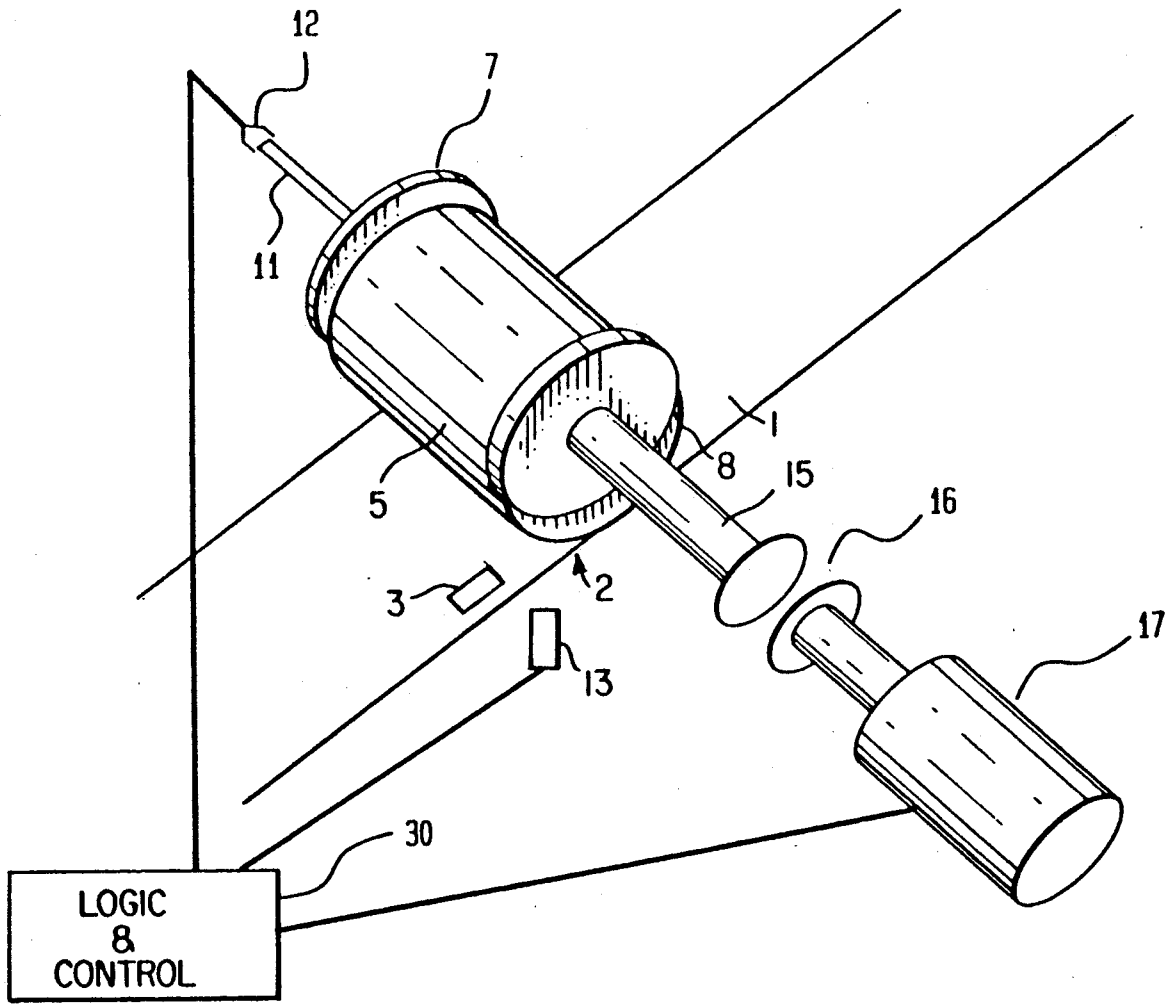
FIG. 1 is a perspective view with many parts eliminated illustrating the basic parts of a transfer station constructed according to the invention.

According to FIG. 1, and image member 1 has a series of toner images which are being moved through a transfer station 2. Image member 1 has image location indicia, for example, perforation 3, along one edge. Perforation 3 can be a single perforation per frame or a series of perforations which can be optically or physically or otherwise sensed to control the creation of an electrostatic image on image member 1. For example, sensing of perforation 3 can be used to actuate a start of scan signal for a laser exposure or to actuate a flash exposure.

Figure 2:
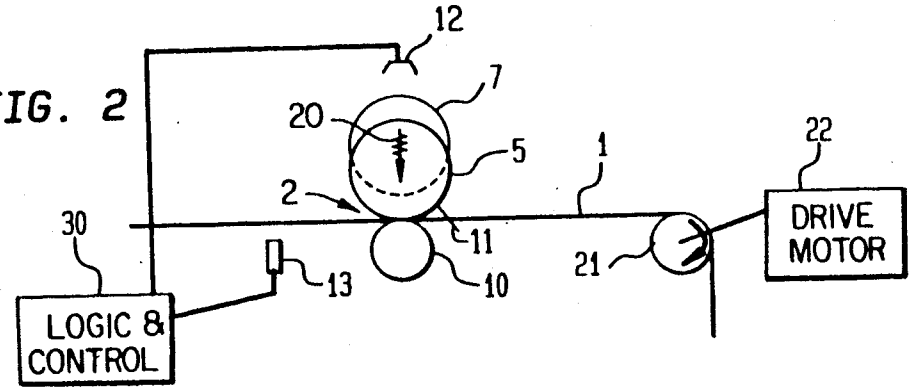
FIGS. 2, 3 and 4 are side schematic views of the apparatus shown in FIG. 1 illustrating its operation.

Transfer station 2 includes a transfer member, for example, a transfer drum 5. A receiving sheet (not shown in FIG. 1) is secured to the periphery of drum 5. Transfer drum 5 is urged by appropriate mechanical means, for example, spring 20 shown in FIGS. 2–4 toward engagement with the image member 1 which is backed by a backing roller 10, also shown in FIGS. 2–4. For clarity of illustration in FIGS. 1–4 image member 1 is shown without substantial wrap around backing roller 10, although in many machine configurations image member 1 would wrap backing roller 10. As shown in FIG. 2 image member 1 is driven through an endless path (not fully shown) by a drive roller 21 driven by a drive motor 22.

Caming disks 7 and 8 are fixed to opposite ends of transfer drum 5. They are circular in shape having a circular outer caming surface and are mounted about a common axis of rotation, which axis is offset from the axis of rotation of transfer drum 5. Caming disks 7 and 8 periodically engage backing roller 10 as shown in FIGS. 2–4 to move transfer drum 5 with cooperation of spring 20 into and out of engagement with image member 1 as the transfer drum rotates.

Transfer drum 5 also includes a timing indicia, for example, projection 11 which rotates with transfer drum 5 and is sensed by an optical sensing device 12 at a single predetermined position in the rotation of transfer drum 5. An additional optical sensing device 13 is positioned to sense the passage of the image location indicia 3 as it passes a predetermined position approaching transfer station 2.

A drive shaft 15 for transfer drum 5 is connected to a clutch 16 which in turn is connected to a stepper motor 17 for driving transfer drum 5 when clutch 16 is engaged.

In operation, referring to FIGS. 1–4, clutch 16 is disengaged as a toner image is transferred to a receiving surface on a receiving sheet secured to the periphery of drum 5. This condition is illustrated particularly in FIG. 2. Engagement between transfer drum 5 and image member 1 drives the transfer drum to rotate through the necessary arc to transfer the image to the receiving sheet. As the image completes its transfer to the receiving sheet cam disks 7 and 8 which are rotating with drum 5 begin to engage the portion of backing roller 10 outside of image member 1 and begin to separate transfer drum 5 from image member 1. As separation is complete, image member 1 no longer drives transfer drum 5. Clutch 16 is engaged and stepper motor 17 drives transfer drum 5 in the same direction it was driven by image member 1 until the location of indicia 11 is sensed by sensing member 12. At this point, stepper motor 17 is stopped with clutch 16 still engaged. Perforation 3 is sensed by sensing means 13 and that information is fed into logic and control 30. In timed relation with the sensing of perforation 3 stepper motor 17 is started again with clutch 16 still engaged to rotate transfer drum 5 until it again engages image member 1 to receive transfer of the next image. Once transfer member 5 is fully engaged with image member 1, clutch 16 is disengaged and the process is repeated for the next image.

Stepper motor 17 is timed to drive transfer drum 5 at a speed that is substantially identical with that of image member 1 so that the actual point of reengagement is not critical. We have found that with a quality stepping motor 17 and quality optical sensing devices 12 and 13, images can be superimposed with a variance of substantially less than 0.001 inches.

Restarting of stepper motor 17 in timed relation to the sensing of perf 3 could be accomplished directly in response to sensing of perforation 3. However, it is preferable to delay the start of stepper motor 17 a certain number of computer clock pulses, for example, 100 pulses, after sensing perforation 3 for actuation of motor 17. This allows adjustments in either direction in the timing to handle variations in parameters of the machine.

Note that the critical aspects of the timing of the apparatus are the timing of the start of stepper motor 17 in reengagement and the accuracy of sensing devices 12 and 13, each of which can be performed by high quality, presently available, components.

FIG. 1 shows the use of clutch 16 for engagement and disengagement of motor 17. These are not actions that are critical to registration if the speed of drum 5 is equal to the speed of image member 1 when the drum and image member reengage. Clutch 16 may be eliminated using available stepper motors which are free wheeling when no power is applied to their windings and either stopped or started in response to a particular electrical signal. The shaft of motor 17 would then always be connected to drum 5, eliminating both the cost of clutch 16 and any error it may introduce.

Cam disks 7 and 8 do not have to be circular disks attached to drum 5. They could be any means for engaging and disengaging drum 5 periodically.

Transfer drum 5 is shown as a drum which receives a transfer sheet on its periphery, which transfer sheet would be held to the drum by conventional means, for example, vacuum holes, gripping fingers, electrostatics, or the like. However, it could also have a surface capable of receiving the images in registration directly, to form the multicolor image on the surface of the drum itself. Such a multicolor image would then be transferred at a position remote from the imaging member 1 to a receiving sheet fed thereto in a single step, a process which is well-known in the art. In this approach, preciseness in the superimposing of the images when transferred from image member 1 determines the quality of the image, while preciseness in the second transfer to the receiving sheet determines only its location on the receiving sheet. Thus, the preciseness available with the inventive apparatus is useful in this process as well.

FIG. 5 shows an embodiment of the invention comparable very much to the embodiment shown in FIGS. 1–4 but in which the image member is a drum rather than an endless belt. According to FIG. 5, an image member, for example, a photoconductive drum 50 is rotated by a motor 51 through a series of stations. Photoconductive drum 50 is first uniformly charged at a charging station 52 and then imagewise exposed at an exposure station, for example, by laser exposing device 53 to create a series of electrostatic images. The electrostatic images are toned with different colored toners by toning stations 54, 55, 56 and 57 to create a series of different colored toner images and those toner images are transferred to a receiving sheet carried by a transfer drum 60 which is driven by photoconductive drum 50 during such transfer. The surface of photoconductive drum 50 is cleaned by a cleaning device 65 for reuse. Transfer of toner images to the receiving sheet carried by transfer drum 60 is assisted by internally heating transfer drum 60 by heating means 62.

Reindexing of transfer drum 60 is done substantially the same as in FIGS. 1–4. A cam 70 rotating with transfer drum 60 engages and disengages from photoconductive drum 50 to separate and reengage transfer drum 60 with photoconductive drum 50. When out of engagement, transfer drum 60 is driven by a stepper motor 67 to align projection 11 with sensing device 12 and then to rotate the drum 60 to its correct position for reengagement with photoconductive drum 50 in response to the position of the next image.

Sensor 13 is shown in FIG. 5 as well as in FIGS. 1–4 for sensing a mark on photoconductive drum 50 to time the rotation of transfer drum 60 in its path toward reengagement as in FIGS. 1–4. However, sensor 13 could be dispensed with utilizing an encoder 70 on photoconductive drum 50 which encoder 70 feeds the angular position of photoconductive drum 50 to logic and control 30 continually. Utilizing the encoder 70 both the position of the original exposure from laser exposing device 53 and the beginning of rotation of stepper motor 67 from the position at which projection 11 and sensing device 12 are lined up can be properly timed without the use of sensing device 13. An encoder can also monitor the rotational position of transfer drum 60 replacing sensor 12 and indicia 11.

FIG. 6 illustrates a type of transfer in which this structure is particularly useable. It is more completely disclosed in U.S. Pat. No. 4,968,578, Rimai et al, issued Nov. 6, 1990. This disclosure is not intended to be limiting on the invention but only illustrative of a particularly useful application thereof. According to FIG. 6, transfer drum 60 is shown with a receiving sheet 75 secured to its periphery, for example, by vacuum holes (not shown). Receiving sheet 75 is a multilayer structure which includes an outer heat softenable thermoplastic layer 76 (exaggerated in size in FIG. 6). Transfer drum 60 is heated internally by lamp 62 as shown in both FIGS. 5 and 6. Receiving sheet 75 can also be heated externally by external radiant heating device 80. Both heating devices 62 and 80 serve to soften the outer layer 76 on receiving sheet 75 and also to raise the temperature in the nip between photoconductive drum 50 and transfer drum 60. As shown in FIG. 6 the toner image (greatly exaggerated in size) is carried on the surface of photoconductive drum 50 into transfer engagement with receiving sheet 75 where the toner is also heated and softened or sintered by the heat from receiving sheet 75. The combination of the softening of the surface of receiving sheet 75 and the softening of the toner effects transfer of the toner to the receiving sheet. This is substantially assisted by pressures in excess of 40 pounds per square inch and preferably well in excess of 100 pounds per square inch. Such pressures can be provided by utilizing hard drums in both instances. For example, a photoconductor coated on an aluminum backing comprising photoconductive drum 50 and an aluminum drum 60 to which receiving sheet 75 is attached creates a very narrow but relatively high pressure nip and also provides for very good heat transfer to heat softenable layer 76 and the toner without overheating the photoconductive surface on drum 50.

The invention has been described in detail with particular reference to a preferred embodiment thereof, but it will be understood that variations and modifications can be effected within the spirit and scope of the invention as described hereinabove and as defined in the appended claims.

We claim:

1. Multicolor image forming apparatus comprising:
- a movable image member,
- means for moving said image member along an endless path,
- means for forming a series of electrostatic images on said image member,
- means for applying different color toners to said electrostatic images to form a series of different color toner images,
- transfer means for transferring said toner images to a receiving surface in registration to form a multicolor image, said transfer means including
  - a transfer member defining or supporting said receiving surface on its periphery,
  - means for moving said transfer member through a path which path includes a portion in which said transfer member is driven by said image member during transfer of an image to said receiving surface and a portion in which said transfer member is out of driving engagement with said image member, and
  - means for rotating said transfer member at least a portion of the time it is out of such driving engagement and for timing said rotation with the movement of said image member to register said toner images on the receiving surface.

2. The multicolor image forming apparatus according to claim 1 wherein said transfer member is a transfer drum.

3. Apparatus according to claim 2 wherein said transfer drum includes timing indicia and said apparatus includes means for sensing the presence of said timing indicia at a predetermined drum location and said apparatus includes means for determining that an image to be transferred is at a predetermined image location and said means for rotating said drum includes means for rotating said drum until said timing indicia is located at said predetermined location and for rotating said drum from said predetermined drum location in timed relation to the determination that an image to be transferred is at the predetermined image location.

4. Apparatus according to claim 3 wherein said rotating means is a stepper motor.

5. Apparatus according to claim 1 wherein said rotating means is a stepper motor.

6. Apparatus according to claim 3 wherein said image member is an endless belt and said determining means includes image location indicia on said belt and means for sensing said image location indicia.

7. Apparatus according to claim 6 wherein said image location indicia also is used to control formation of said electrostatic images.

8. Apparatus according to claim 3 wherein said determining means also is used to control the formation of said electrostatic images.

9. Apparatus according to claim 2 wherein said receiving surface is a surface of a receiving sheet secured to the periphery of said drum.

10. Apparatus according to claim 2 wherein said receiving surface is the periphery of said drum.

11. Apparatus according to claim 2 wherein said means for rotating said drum includes means for rotating said drum to a predetermined position and for stopping at that position and for beginning rotation of said drum from said predetermined position in timed relation to the position of said imaging member in its endless path.

12. Apparatus according to claim 1 wherein said transfer means includes means for separating said transfer member and said image member and for reengaging said transfer member and said image member.

13. Apparatus according to claim 12 wherein said separating and reengaging means is cam means which moves in timed relationship with the movement of said transfer member.

14. Apparatus according to claim 2 wherein said transfer means includes cam means fixed for rotation with said drum for separating said drum and said image member and for controlling reengagement of said drum and said image member.

15. Apparatus according to claim 9 wherein said transfer means includes means for heating a receiving sheet carried on the periphery of said drum.

16. Apparatus according to claim 15 wherein said transfer means includes means for heating a heat softenable outer layer of said receiving sheet.

17. Means for transferring a series of toner images carried by a moving image member in registration to a receiving sheet comprising:

a transfer drum for supporting said sheet on its periphery and moving it through a cycling path, which path includes a portion in which said sheet contacts said image member and said drum is driven through such contact by said image member while a toner image is transferred to said receiving sheet and a portion in which said sheet is separated from said image member, and means for reindexing said drum with respect to said image member each time said drum is separated from said image member to provide registration of toner images on said receiving sheet.

18. Apparatus according to claim 17 including means for applying a pressure greater than 40 psi between the image member and the drum while in contact.

19. Apparatus according to claim 17 wherein said image member is a photoconductive drum.

20. Apparatus according to claim 19 including means for sensing the rotational position of said photoconductive drum and for controlling the reindexing of said transfer drum in response thereto.

21. Apparatus according to claim 20 wherein said reindexing means includes means for rotating said transfer drum to a predetermined rotational position and means for rotating said transfer drum from said predetermined position in response to said sensing means.

22. Apparatus according to claim 21 wherein apparatus includes means for separating and for reengaging said drums, and said means for rotating includes means for rotating said transfer drum at a speed such that the outer surface of said receiving sheet and the surface of said photoconductive drum are moving at the same speed when reengaged.

23. Apparatus according to claim 18 including means for heating said receiving sheet to facilitate transfer of said toner images.

24. Apparatus according to claim 23 wherein said heating means heats at least a heat softenable outer layer of said receiving sheet.

25. Apparatus according to claim 22 wherein said means for rotating is a stepper motor.

26. A method of transferring a series of toner images from a moving image member in registration to a heat softenable outer layer of a receiving sheet supported on the outer periphery of a transfer drum, said method including heating said heat softenable layer to at least its softening point and rotating said transfer drum to provide repeated pressure contact between said images and said softened layer to transfer said images thereto, said method being characterized in that the step of rotating said drum includes rotating said drum by said image member during transfer of said images, separating said drum and image member between transfers and reindexing said drum with respect to the location of the next image on said image member and then reengaging said drum and image member.

27. A method of transferring a plurality of different color single color images to a receiving sheet in registration to form a single multicolor image on said sheet, said method comprising:

securing a receiving sheet to a rotatable transfer drum, forming a series of electrostatic images on a moving image member, toning said electrostatic images with toners of colors which are different from image to image to create a series of different color single color toner images, transferring said single color toner images one after another to said receiving sheet in registration to form a multicolor toner image thereon, said transferring step including rotating said transfer drum by contact between said moving image member and said receiving sheet while transferring a single color toner image from said image member to said receiving sheet, rotating said transfer drum by means independent of said image member between transfers of single color images, and controlling such rotation of said transfer drum between transfer of said single color images to accurately register said single color toner images to form an accurately registered multicolor image on said receiving sheet.

28. The method according to claim 27 wherein said securing step includes securing a receiving sheet having a heat-softenable layer to a rotatable transfer drum with the heat-softenable layer facing away from the drum, and wherein said transferring step includes applying sufficient pressure and heat to said heat-softenable layer and said toner image to transfer said toner image to said receiving sheet.

* * * * *